US006595291B1

(12) United States Patent
Lia et al.

(10) Patent No.: US 6,595,291 B1
(45) Date of Patent: Jul. 22, 2003

(54) PROCESS OF PREPARING A GAS COMPOSITION AND USE THEREOF

(75) Inventors: Torbjörn A. Lia, Tranby (NO); Simen Elvestad, Oslo (NO); Auke Lont, Oslo (NO)

(73) Assignee: Naturkraft AS, Lysaker (NO)

( * ) Notice: Subject to any disclaimer, the term of this patent is extended or adjusted under 35 U.S.C. 154(b) by 0 days.

(21) Appl. No.: 09/701,554

(22) PCT Filed: May 31, 1999

(86) PCT No.: PCT/NO99/00168

§ 371 (c)(1),
(2), (4) Date: Feb. 28, 2001

(87) PCT Pub. No.: WO99/64719

PCT Pub. Date: Dec. 16, 1999

(30) Foreign Application Priority Data

May 29, 1998 (NO) ..... 19982491

(51) Int. Cl.[7] ..... E21B 43/16; E21B 43/18

(52) U.S. Cl. ..... 166/305.1; 166/90.1; 166/268; 60/783; 252/372; 423/351; 431/5

(58) Field of Search ..... 166/90.1, 268, 166/303, 309.1, 401, 402; 60/84, 783; 252/372; 423/351; 431/2, 5

(56) References Cited

U.S. PATENT DOCUMENTS 3,150,716 A * 9/1964 Strelzoff et al. ..... 166/268
4,353,207 A * 10/1982 Lee ..... 60/39.182
4,448,577 A 5/1984 Paczkowski ..... 431/190
4,895,710 A 1/1990 Hartmann et al. ..... 423/351
4,936,088 A * 6/1990 Bell ..... 60/777
5,134,841 A * 8/1992 Rehwinkel et al. ..... 60/781
5,260,043 A * 11/1993 Li et al. ..... 423/351
5,884,470 A * 3/1999 Frutschi ..... 60/783

FOREIGN PATENT DOCUMENTS

CA 2018266 12/1991
EP 0162368 11/1985

* cited by examiner

*Primary Examiner*—George Suchfield
(74) *Attorney, Agent, or Firm*—Ladas & Parry

(57) ABSTRACT

The present invention provides a process of preparing of a gas composition suitable for the injection in an oil-containing field to increase the degree of recovery and simultaneously reduce the discharge of $CO_2$ to the atmosphere. However, injection of a gas composition containing large amounts of oxygen will result in a degraded submarine formation which is not desirable. The present invention relates to a process for the production of a gas composition comprising $N_2$, $CO_2$, minor parts of $NO_x$, VOC (volatile organic compounds) and about 0–2.0 mole % $O_2$ from an oxygen containing exhaust gas, wherein a stream of an exhaust gas from the combustion of air and natural gas in a gas turbine containing 18% by weight $O_2$ or less, is combusted with natural gas, whereupon the desired gas composition is discharged as a flue gas. Further, a process of recovering oil from submarine formations is also described, where said gas composition is compressed and injected into a submarine formation. The use of previous said gas composition for injection in an oil-containing field for the recovery of oil is also disclosed by the present invention.

4 Claims, 1 Drawing Sheet

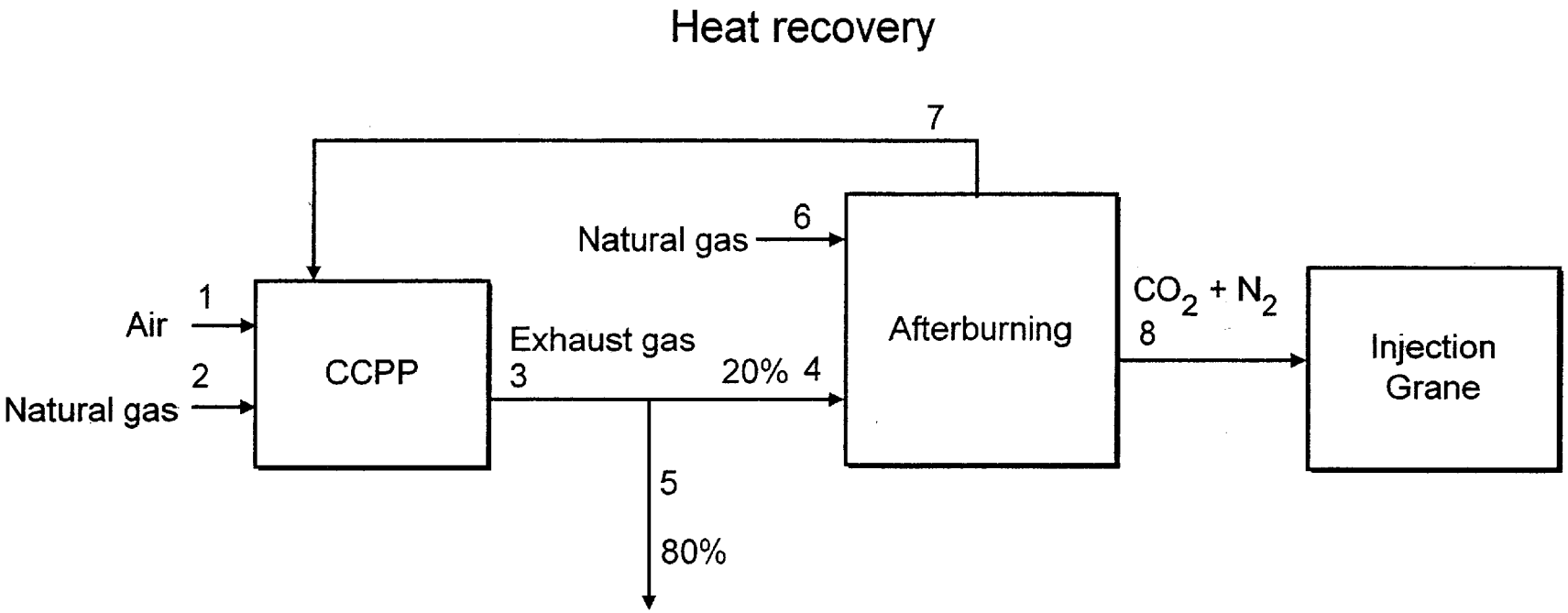
Heat recovery
7
Natural gas
6
Exhaust gas
3
20% 4
5
80%
Afterburning
$CO_2 + N_2$
8
Injection
Grane
CCPP
1
Air
2
Natural gas

PROCESS OF PREPARING A GAS COMPOSITION AND USE THEREOF

FIELD OF THE INVENTION

The present invention relates to a process of preparing a gas composition comprising $N_2$, $CO_2$, minor parts of $NO_x$, VOC (volatile organic compounds) and about 0–2.0 mole % $O_2$ from an oxygen containing exhaust gas and use thereof.

BACKGROUND OF THE INVENTION

It is well-known to inject $CO_2$ in submarine formations and oil-containing fields to reduce the discharge of $CO_2$ to the atmosphere. Injection of $CO_2$ into oil-containing fields simultaneously increases the recovery of oil from said oil-containing field. Further it is also known to produce electrical power from fossil fuel. Increasing the quantity of oil recovery by water injection, nitrogen and $CO_2$ separated from a oil/gas mixture is also known in the art.

Large quantities of gas are required to recover oil in an oil-containing field by injection of a gas $CO_2$ can be obtained by separating $CO_2$ either from the feed gas or from combustion flue gas e.g. from a gas power plant. Large amounts of flue gas are required when only the $CO_2$ in the combustion flue gas is used for injection in oil-containing fields to recover oil, since the typical content of $CO_2$ is in the magnitude of 3–10 mole %. The remainder of the combustible constituents are conveyed forward for combustion for the production of electrical power by purification of the feed gas (e.g. upstream to a gas power plant). The remainder of the constituents are conveyed to the atmosphere by purification of the combustion gas (e.g. downstream to a gas power plant). Due to the large gas quantities that are required for injection in oil-containing fields to increase the recovery of oil, an inert gas composition consisting mainly of $CO_2$ can be obtained by the separation of $CO_2$ from a fuel gas or a flue gas in a gas fired power plant where the production of large amounts of electrical power is involved. Said production of electrical power may cause problems concerning sales of electrical power and in particular cases transmission capacity of electrical power.

SUMMARY OF THE INVENTION

The object of the present invention is to provide a process of preparing a gas composition suitable for injection in an oil-containing field in such a way to increase the degree of recovery and simultaneously reduce the discharge of $CO_2$ to the atmosphere. However, injection of a gas composition containing large amounts of oxygen will result in a degraded submarine formation, which is not desirable. The present invention thus provides a process for the production of a gas composition comprising $N_2$, $CO_2$, minor parts of $NO_x$, VOC (volatile organic compounds) and about 0–2.0 mole % $O_2$ from an oxygen containing exhaust gas, wherein a stream of a exhaust gas from the combustion of air and natural gas in a gas turbine containing 18% by weight $O_2$ or less, is combusted with natural gas, whereupon the desired gas composition is discharged as a flue gas. The content of $O_2$ in the exhaust gas from the combustion of air and natural gas in a gas turbine is in the magnitude of 12–18% $O_2$. The gas composition obtained preferably contains about 0 to 1.0 mole % $O_2$, and more preferably about 0.1–0.5 mole % $O_2$. The present invention may utilise any exhaust gas from a combustion process, but a preferred embodiment of the invention is the production of an inert gas composition from the combustion products from a gas turbine plant. The present invention also comprises a process of recovering oil from submarine formations wherein a gas composition as mentioned above, comprising $N_2$, $CO_2$, minor parts of $NO_x$ and VOC (volatile organic compounds), and $O_2$ is further compressed and injected into said submarine formation. Further, the use of a gas composition comprising $N_2$, $CO_2$, minor parts of $NO_x$, VOC (volatile organic compounds) and about 0–2.0 mole % $O_2$ from an oxygen containing flue gas for injection in an oil-containing field for the recovery of oil is also disclosed by the present invention.

The present Invention thus comprises a process of preparing a gas composition where said gas composition contains from 0–1.0 mole % $O_2$, more preferably from 0.1–0.5 mole % $O_2$. Previous problems concerning the degradation of oil-containing fields are reduced by said amounts of $O_2$ which also are to be considered as minor. The process comprises eliminating molecular oxygen of the exhaust gases by charging a metered amount of fuel sufficient to combust the remaining amounts of oxygen almost completely (stoichiometric or reaction equivalent combustion) in a steam boiler. Steam is generated in the steam boiler, which is utilised for operating a vapor turbine which further operates an electrical generator.

One of the objects of preparing an inert gas composition as described herein is that said process also addresses an energy economy aspect. Large amounts of an inert gas composition are also provided by preparing a gas composition from any exhaust gas of a combustion process, not only using $CO_2$ as an inert gas, but wherein also the remaining components, except for $O_2$ are used. The amount of $CO_2$ prepared from natural gas constitutes only 8 to 10% of the total gas amounts of the present invention. Combustion of exhaust gas from, e.g., a gas turbine plant is produced in stoichiometric amounts, whereby the remaining amounts of $O_2$ are mainly converted to $CO_2$. According to the present invention, a smaller gas turbine plant is thus provided including large amounts of exhaust gas per generated amounts of electric power for the preparation of a desired amount of an inert gas composition. The injection of an inert gas in an oil-containing field provides for the reduction of discharge to the atmosphere of $CO_2$ from the power plant.

The present process can be preformed in a processing plant onshore or on an offshore installation such as a platform or a barge. The production of electric power according to the present invention on a offshore installation or an oil drilling platform, will provide a contribution to or a coverage of the power demand. A further advantage of such an offshore installation at oil-containing fields is the possibility of moving it from one field to another.

The temperature of the flue gases after combustion is decided by the exploitation ratio and the dimensioning of the steam boiler. The flue gases are dried and compressed to the desired pressure dependent on the character of the reservoir prior to injection.

The invention is described in more detail in the following referring to examples and the enclosed figures.

BRIEF DESCRIPTION OF THE DRAWING

FIG. 1 is a flowsheet of a combined gas power plant (CCPP—Combined Cycle Power Plant).

DETAILED DESCRIPTION OF THE INVENTION

The gas power plant depicted in FIG. 1 comprises a device for afterburning. Air (stream 1) and natural gas (stream 2) is fed to a CCPP, from which an exhaust gas (stream 3) is discharged. One part, shown in FIG. 1 as 20% of the amount of the exhaust gas from the CCPP (stream 4)), is then fed to an afterburning device to which also fuel in the form of natural gas (stream 6) is fed. The desired gas composition (stream 8) from the afterburning device is further fed to drying and compression apparatus prior to the injection of the gas composition into an oil-containing field for recovering oil. The drying and compression devices are omitted in FIG. 1.

EXAMPLE 1

Example 1 elucidates the composition and the amount of natural gas (stream 6) which is conveyed into the afterburning device, shown in table 1, together with the exhaust gas from the combustion of air and natural gas in a gas turbine (stream 4), as shown in table 2. Further, the composition and amounts of the gas composition produced containing $N_2$, $CO_2$, minor parts of $NO_x$ and VOC (volatile organic compounds), and about 0–2.0 mole % $O_2$ from an oxygen containing exhaust gas (stream 8) is shown in the example. The amounts and the composition of stream 8, which moreover is the desired gas composition, is given in table 3.

TABLE 1

| Components in natural gas (steam 6) | | Mole % | % by weight | MW |
|---|---|---|---|---|
| $CH_4$ | Methane | 93.261 | 86.704 | 16.043 |
| $C_2H_6$ | Ethane | 3.531 | 6.152 | 30.069 |
| $C_3H_8$ | Propane | 0.659 | 1.684 | 44.097 |
| $C_4H_{10}$ | Isobutane | 0.309 | 1.040 | 58.123 |
| $C_4H_{10}$ | n-butane | 8.77E-02 | 0.296 | 58.123 |
| $C_5H_{12}$ | Isopentane | 5.15E-02 | 0.215 | 72.150 |
| $C_5H_{12}$ | n-pentane | 2.15E-02 | 8.99E-02 | 72.150 |
| $C_6H_6$ | Benzene | 5.62E-02 | 0.254 | 78.114 |
| $N_2$ | Nitrogen | 1.719 | 2.790 | 28.014 |
| $CO_2$ | Carbon dioxide | 0.302 | 0.771 | 44.010 |
| $H_2O$ | Water | 3.00E-03 | 3.13E-03 | 18.015 |
| Gas density @ 1.013 bar, OC | | | 0.7697 kg/m$^3$ | |

TABLE 2

| Components in exhaust gas (stream 4) | | Mole % | % by weight | MW |
|---|---|---|---|---|
| $O_2$ | Oxygen | 12.4 | 13.963 | 31.999 |
| $N_2$ | Nitrogen | 74.39 | 73.335 | 28.014 |
| $CO_2$ | Carbon dioxide | 3.98 | 6.164 | 44.010 |
| $H_2O$ | Water | 8.34 | 5.287 | 18.015 |
| Ar | Argon | 0.89 | 1.251 | 39.948 |
| Gas density @ 1.013 bar, OC | | | 1.269246 kg/m$^3$ | |

TABLE 3

| Components in exhaust gas (stream 8) | | Mole % | % by weight | MW |
|---|---|---|---|---|
| $O_2$ | Oxygen | 0.5 | 0.576 | 31.999 |
| $N_2$ | Nitrogen | 70.304 | 70.947 | 28.014 |
| Ar | Argon | 0.840 | 1.209 | 39.948 |
| $Co_2$ | Carbon dioxide | 9.468 | 15.010 | 44.010 |
| $H_2O$ density | Water | 18.889 | 12.258 | 18.015 |
| Gas density @ 1.013 bar, OC | | | 1.241732 kg/m$^3$ | |

What is claimed is:

1. A process of recovering oil from a submarine formation, comprising the steps of:

preparing a gas composition comprising $N_2$, $CO_2$, minor parts of $NO_x$ and VOC (volatile organic compounds), and about 0–2.0 mole % $O_2$ from an oxygen containing exhaust gas by combusting a stream of exhaust gas from the combustion of air and natural gas in a gas turbine containing 18% by weight $O_2$ or less with natural gas to form a desired gas composition and discharging the desired gas composition as a flue gas; and compressing and injecting said gas composition into said submarine formation.

2. The process of claim 1, further comprising the step of recovering oil from said submarine formation.

3. The process of claim 1, wherein the gas composition contains about 0 to 1.0 mole % $O_2$.

4. The process of claim 3, wherein the gas composition contains about 0.1 to 0.5 mole % $O_2$.

* * * * *